US005231717A

United States Patent [19]

Scott et al.

[11] Patent Number: 5,231,717

[45] Date of Patent: Aug. 3, 1993

[54] BEDDING SYSTEM

[75] Inventors: Terence A. Scott; Robert D. Oexman, both of Carthage; Earl W. Kennedy, Joplin, all of Mo.

[73] Assignee: Leggett & Platt, Incorporated, Carthage, Mo.

[21] Appl. No.: 905,085

[22] Filed: Jun. 24, 1992

Related U.S. Application Data

[63] Continuation of Ser. No. 613,129, Nov. 13, 1990, abandoned, which is a continuation-in-part of Ser. No. 397,660, Aug. 23, 1989, abandoned.

[51] Int. Cl.[5] ..... A47C 27/00

[52] U.S. Cl. ..... 5/464; 5/400

[58] Field of Search ..... 5/131, 132, 400, 401, 5/448, 464, 465

[56] References Cited

U.S. PATENT DOCUMENTS

| | | | |
|---|---|---|---|
| 2,563,124 | 9/1946 | Mather . | |
| 2,651,788 | 5/1950 | Forwood . | |
| 3,072,927 | 1/1963 | Julin | 5/131 |
| 3,083,380 | 12/1961 | Adler . | |
| 3,166,768 | 6/1962 | Cunningham . | |
| 3,210,781 | 1/1962 | Pollock . | |
| 3,521,311 | 3/1968 | Cohen . | |
| 3,534,417 | 10/1970 | Boyles . | |
| 3,736,605 | 6/1973 | Klein, Jr. | 5/401 |
| 3,769,643 | 11/1973 | Adler . | |
| 3,828,378 | 8/1974 | Flam . | |
| 3,846,857 | 11/1974 | Weinstock . | |
| 3,885,258 | 5/1975 | Regan . | |
| 4,051,566 | 10/1977 | Esquivel . | |
| 4,053,957 | 10/1977 | Regan . | |
| 4,054,960 | 10/1977 | Pettit . | |
| 4,110,854 | 9/1978 | Sjolie | 5/411 |
| 4,197,602 | 4/1980 | Johenning | 5/411 X |
| 4,213,214 | 7/1980 | Gilhooly . | |
| 4,389,743 | 6/1983 | Callaway | 5/464 |
| 4,625,351 | 12/1986 | Campian | 5/401 X |
| 4,628,557 | 12/1986 | Murphy . | |
| 4,631,768 | 12/1986 | Ferrall . | |
| 4,662,012 | 5/1987 | Torbet . | |
| 4,677,701 | 7/1987 | Galumbeck . | |
| 4,679,266 | 7/1987 | Kraft . | |
| 4,706,313 | 11/1987 | Murphy . | |
| 4,719,656 | 1/1988 | Godinet | 5/401 |
| 4,843,666 | 7/1989 | Elesh et al. . | |
| 4,879,776 | 11/1989 | Farley | 5/464 X |
| 4,972,536 | 11/1990 | Scott | 5/464 |

FOREIGN PATENT DOCUMENTS

| | | |
|---|---|---|
| 657923 | 9/1951 | United Kingdom . |
| 1387195 | 3/1975 | United Kingdom . |
| 1518845 | 7/1978 | United Kingdom . |

*Primary Examiner*—Peter M. Cuomo
*Assistant Examiner*—Michael Milano
*Attorney, Agent, or Firm*—Wood, Herron & Evans

[57] ABSTRACT

A modular bedding system which comprises a rigid non-resilient platform having depressions formed in the top surface thereof for the reception of resilient cushions, and a relatively thin mattress supported atop that platform and the cushions. In one preferred embodiment, there is a depression and one cushion located beneath the shoulders of a person reclining atop the mattress of the bedding system and a second cushion located beneath the hips of a person reclining atop the system. In another preferred embodiment, there is a single cushion located in a single depression of the bed but the cushion extends beneath the shoulders to beneath the hips of a person reclining atop the mattress and has a zone of increased firmness located beneath the waist of that person.

19 Claims, 7 Drawing Sheets

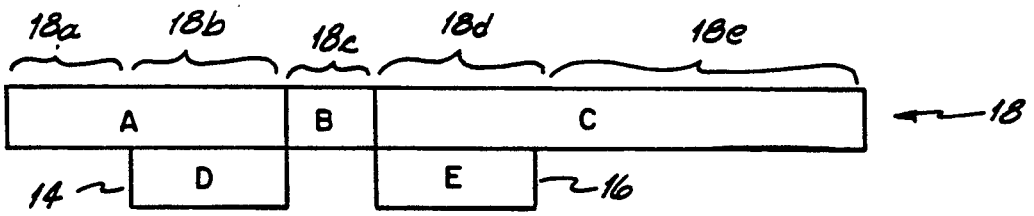

A- MATTRESS ZONE HEAD AND SHOULDERS-----FIRMNESS 1

B- MATTRESS ZONE WAIST---------- FIRMNESS 3

C-MATTRESS ZONE HIP AND FOOT--------- FIRMNESS 1

D-BASE INSERT-ZONE SHOULDER--------- FIRMNESS 1

E-BASE INSERT-ZONE HIP---------- FIRMNESS 2

FIG. 7

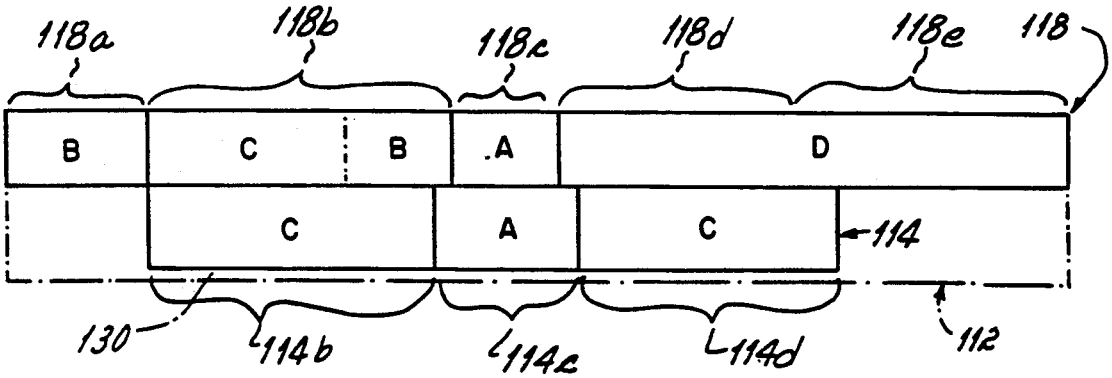

A-MATTRESS AND INSERT WAIST ZONES--------FIRMNESS 1

B-MATTRESS HEAD AND SHOULDER/WAIST CONNECTOR ZONES----------FIRMNESS 2

C-MATTRESS SHOULDER/HEAD CONNECTOR AND INSERT SHOULDER AND HIP ZONES----------FIRMNESS 3

D-MATTRESS HIP AND FOOT ZONES----------FIRMNESS 4

FIG. 8

BEDDING SYSTEM

This application is a continuation of application Ser. No. 07/613,129, filed Nov. 13, 1990, now abandoned, which is in turn a continuation-in-part application of application Ser. No. 06/397,660, filed Aug. 23, 1989, now abandoned.

This invention relates to bedding systems and, more particularly, to a bedding system for maximizing the comfort of a person reclining atop the system.

Sleep studies and sleep research have increasingly confirmed that the quality of a person's sleep is dependent upon the comfort of that person when reclining atop a sleeping surface. Researchers have also determined that comfort is affected by the spinal alignment of a person reclining atop a mattress or the amount of pressure that is applied to the body surface of a person atop a mattress. Spinal alignment is generally defined, for purposes of such research studies, as that alignment which the spine of a person assumes when that person is standing in a relaxed position with the feet approximately 12 inches apart. This is the position of the spine which should ideally be maintained when that person is reclining atop a sleeping surface. When a healthy sleeper becomes "uncomfortable," either consciously or subconsciously, they may move to relieve the discomfort. During the night, a healthy person passes through five levels of sleep, which are called stages I-IV and REM (Rapid Eye Movement). Stages I and II are the lightest sleep, and stages III and IV are the deepest. The REM stage is that level in which we dream. All levels of sleep are important, but it is in stages III and IV that we get our deepest, most restful sleep. Postural shifts of the body during the night are a normal and healthy part of the sleeping cycle. When a sleeper moves, they must arouse to a lighter level of sleep (stage I or II) or awaken. Therefore, the more discomfort a sleeper feels during the night, the more they will move, which will require them to spend more time in lighter levels of sleep and less time in deeper, more restful sleep.

In Torbet U.S. Pat. No. 4,662,012 and in co-pending U.S. patent application Ser. No. 07/256,902 filed Oct. 12, 1988 and assigned to the assignee of this application, there is disclosed an air mattress for supporting a person in a reclining position while maintaining spinal alignment of that person and while maintaining minimal supporting body surface pressure. To that end, the mattresses disclosed in both the above-identified patent and pending application utilize zones of differing air pressure along the length of the mattress. This is in contrast to a conventional non-zoned type of mattress which maintains a common degree of firmness or resistance to vertical deflection over the whole surface area and for the full length of the mattress.

Experimentation has now shown that a mattress should be divided into four, and preferably five, longitudinal zones of differing firmness or resistance to vertical deflection in order for the body of a person reclining atop the mattress to be maintained in spinal alignment when lying on either their back or side. Spinal alignment on an air bed of the type described in the above-identified pending patent application is ideally achieved when the mattress is divided into five longitudinal zones, each having a different level of resistance to vertical deflection.

While the air mattress described in U.S. Pat. No. 4,662,012 is ideal for supporting a person reclining atop the mattress while minimizing supporting body surface pressure and while maintaining spinal alignment, spinal alignment can also be achieved by zoned mattresses of more conventional construction, as for example, foam or spring mattresses, so long as the mattresses are zoned or divided into longitudinal sections of differing resistance to vertical deflection. Such a zoned spring mattress is disclosed in Kraft U.S. Pat. No. 4,679,266. But, a zoned foam or spring mattress, such as the zoned mattress of U.S. Pat. No. 4,679,266, cannot, because of the nature of foam or springs, simultaneously achieve spinal alignment and minimal supporting body surface pressure.

In the use of a zoned mattress for achieving spinal alignment of persons reclining atop the mattress, persons of greater body density sink further into the mattress than persons of lower body density. Body protrusions (such as shoulders) also need to be accommodated. In the practice of the invention described in the above-identified air mattress application, the air mattress was required to be approximately eight inches in vertical height over the whole of the surface of the mattress in order that the shoulder of a heavy body resting atop the mattress in a side lying position did not sink through the mattress to the underlying mattress supporting surface. In actuality, the parts of the body which sink furthest into the mattress are the shoulder and the hips of the person reclining atop the mattress.

One of the factors which contributes significantly to the cost of a mattress, be it a zoned mattress of the type described hereinabove or a conventional unzoned mattress of fixed resistance to vertical deflection throughout the length and width of the mattress, is the cost of materials employed in establishing the vertical height of the mattress in order to prevent the mattress from bottoming out when a person is supported atop the mattress. From a cost standpoint alone, an ideal mattress would be one which is substantially less thick than conventional mattresses utilized today, but which has sufficient resiliency over the length of the body to support the body in spinal alignment at lowest possible surface body pressure and which will not allow the body to bottom out. From a functional standpoint, such a mattress would be comfortable because of its maintenance of minimal body supporting surface pressures and maintenance of spinal alignment of a person supported atop the mattress.

In order to support a person reclining atop a mattress with a minimum supporting surface pressure, the person reclining atop the mattress must be lying horizontally and must be supported over the largest possible body surface area. In order to maximize the supporting surface area, the body of the person will necessarily be deep into the supporting mattress, and that mattress will conform absolutely to the body shape. The mattress, of course, will not have bottomed out at any location. The body will have both a varying density and a contour to which the supporting mattress will be applied. Thus, if the body is to rest in spinal alignment when reclining atop the mattress, the supporting forces in the mattress under load from the body must vary along the length of the body to match the body density and shape. If the body is to rest in spinal alignment when reclining atop the mattress at the lowest possible body surface pressure, the supporting pressures in the mattress must be as low as possible in order to permit the optimum or near optimum sinkage of the body into the mattress. Translated into design parameters for a mattress of spring or resilient foam construction, the mattress should ideally be of varying firmness along the length of the mattress, and that firmness should be as little as possible for lowest possible body surface pressure.

As mentioned hereinabove, longitudinally zoned spring mattresses are capable of achieving spinal alignment of a person resting atop the mattress if the mattress is of sufficient depth to allow the shoulders and hips to sink into the mattress to a depth sufficient to maintain spinal alignment of that person. But, spring mattresses or bedding systems employing such mattresses are, as presently known, not capable of achieving spinal alignment while minimizing the supporting surface pressure on the body. The primary reason that this is not possible with compression spring mattresses is that the resistance to deflection of the springs increases as the springs are compressed and the height of compression springs in a mattress is limited. The taller the spring in the relaxed state, the greater is the deflection or compression of the spring before the force increases to balance the weight of a body lying on the spring. Thus, a body can sink further into a tall, weak spring before the weight of the body is balanced than it can sink into a low, firm spring. If the spring is to be made sufficiently weak to enable a person to sink deeply into the mattress, then it must be tall in order to prevent the body of a person supported atop the mattress from bottoming out before the weight of the person is balanced by the resistance of the spring. In order to achieve or permit the greatest possible body penetration into the mattress, and hence, the lowest possible body supporting surface pressure, the springs of the mattress must be sufficiently tall, particularly in the shoulder and hip zones, to enable the body to penetrate deeply into the mattress so as to achieve spinal alignment of the person resting atop the mattress. But, very tall, weak compression springs in a mattress have intolerable lateral sway or instability, and this is especially true as the firmness of the springs is reduced. Thus, at the present time, mattresses are generally limited as a practical matter to compression springs no more than approximately six inches in height and mattresses which, with one-inch pads on each side of the mattress, are a total of approximately eight inches in height. With these limitations in mind, zoned spring mattresses, which have been capable of achieving spinal alignment of a person resting atop the mattress, have not been capable of achieving that spinal alignment with a minimum body supporting surface pressure because they have not allowed a body to sink to a sufficient depth into the mattress to achieve that minimum supporting surface pressure.

It has therefore been one objective of this invention to provide a bedding system which is capable with the use of spring-zoned mattresses of supporting a body in spinal alignment either on their back or side while supporting that body with a minimal supporting surface pressure.

It has been another objective of this invention to provide an improved bedding system which utilizes a mattress of substantially less thickness or vertical dimension, but which, when employed in a complete bedding system, affords spinal alignment of a person reclining atop the mattress, whether on their side or on their back.

Still another objective of this invention has been to provide an improved bedding system which may be customized in order to provide spinal alignment of a particular size and body density of a person supported atop the mattress at a firmness or feel preferred by that person.

The invention of this application relies in part upon a well-known characteristic of compression springs, but one which has, to my knowledge, never heretofore been employed in a bedding system to achieve maximum comfort and spinal alignment. That principle is the well-known one that the spring compression rate (the weight per distance of deflection) is substantially decreased if one compression spring is mounted atop another compression spring. As an example, if a load is placed on a five-inch high spring and deflects it three inches, the same load placed atop two tiers of the same spring (i.e., a five-inch spring placed on top of an identical five-inch spring) will cause the two-tiered spring to deflect six inches. Utilizing this principle, the invention of this application is capable of achieving spinal alignment in a mattress having springs to provide the resiliency of the bedding system while minimizing the body supporting surface pressure on a person reclining atop the mattress of the system.

SUMMARY OF THE INVENTION

The invention of this application which accomplishes these objectives is a modular bedding system which comprises a rigid platform having depressions formed in the top surface thereof for the reception of resilient cushions, and a relatively thin mattress supported atop that platform and the cushions. In one preferred embodiment, there is a depression and one cushion located beneath the shoulders of a person reclining atop the mattress of the bedding system and a second cushion located beneath the hips of a person reclining atop the system. In another preferred embodiment, there is a single cushion located in a single depression of the bed but that cushion extends beneath the shoulders to beneath the hips of a person reclining atop the mattress and has a zone of increased firmness located beneath the waist of that person. In both embodiments, the mattress is approximately four inches in thickness, and the cushions or cushion are each approximately four inches in thickness. The mattress is preferably a longitudinally zoned firmness mattress, i.e., one having multiple zones of differing resistance to vertical deflection over the surface of the mattress, but it should be appreciated that some aspects of this invention lend themselves to the use of a single-zone mattress, i.e., one that is characterized by a common resistance to vertical deflection over the full top surface of the mattress.

The bedding system of this invention lends itself to customizing of a bed to provide spinal alignment at the preferred firmness of a person or customer utilizing such bedding system, including that firmness which provides the lowest possible body surface pressure. Differing persons have differing requirements for their bed. Some prefer a bed which has a very soft, cushiony feel, and others prefer a bed which has a much firmer feel. All, though, for maximum comfort require that the bedding system maintain spinal alignment of their particular size, shape and weight bodies. Because personal preferences differ, there is a need for a bed which maintains spinal alignment of these differing bodies while still satisfying personal preferences for firmness of feel. The invention of this application is particularly amenable to satisfying these requirements. To that end, it is envisioned that this invention will be modularized and sold from a selection of components to make a bedding system customized to a particular customer's personal dimensions and preferences. Specifically, it is envisioned that each customer will be weighed and measured and then mattresses and cushions matched to the dimensions and weight of that particular customer in order to provide a bedding system having the firmness feel desired by the customer while still maintaining spinal alignment of that customer when reclining or resting atop the resulting bed. Thus, a customer might select the particular firmness feel of mattress that he or she desires, including that firmness which provides the lowest possible body surface pressure, and then have that choice matched with his or her physical dimensions and weight in order to determine which of possibly five or more mattresses combined with cushion inserts is the ideal one for that customer. Because of different body densities, a mattress which might be firm for one person might be medium firm for another more dense, heavier person. That mattress would then be matched with a range of cushions in order to give rise to spinal alignment of that customer when supported upon the resulting bedding system. The customer might then select a particular headboard, footboard, bedside cabinets and bed surround in order to complete the bedding system choice.

The determination of which of many mattresses and cushions would be chosen could be determined from a chart, which would indicate for a particular size and density person which mattress would give rise to the requisite degree of firmness and the cushions which would be used in combination with that mattress for that particular person to provide for spinal alignment. Alternatively, a computer program could be used to make the same selection.

While it is envisioned that the invention of this application may be utilized with a zoned air mattress, such as the one described in the above-identified patent application, many of the advantages of this invention may be achieved by utilizing foam or spring mattresses having longitudinal zones of differing resistance to vertical deflection. Or, alternatively, the invention of this application may be used in combination with unzoned mattresses, i.e., mattresses which are of the same resistance to vertical deflection throughout the full length and width of the mattress and which may be combined with cushions of varying firmness. But, one of the principal advantages of the invention of this application is achieved when the mattress is a longitudinally zoned foam or spring mattress used in combination with foam or spring cushions. In that event, the bedding system of this invention is capable of achieving spinal alignment of a person reclining atop the bedding system while minimizing body supporting surface pressures.

One very great advantage of the invention of this application is that it enables a bed to be selected from modular components which may be customized to meet a particular person's weight and dimensions so as to enable that person to sleep on the resulting bedding system with a selected degree of firmness comfort and in spinal alignment. This invention also has the advantage of giving rise to a modular bedding system which may be created from less expensive components than prior art bedding systems and which may be transported more easily and assembled by the user.

These and other objects and advantages of this invention will become more readily apparent from the following description of the drawings in which:

FIG. 7 is a diagrammatic illustration of a bedding system embodying the invention of this application.

FIG. 8 is a diagrammatic illustration of a second embodiment bedding system embodying the invention of this application.

Figure 1:
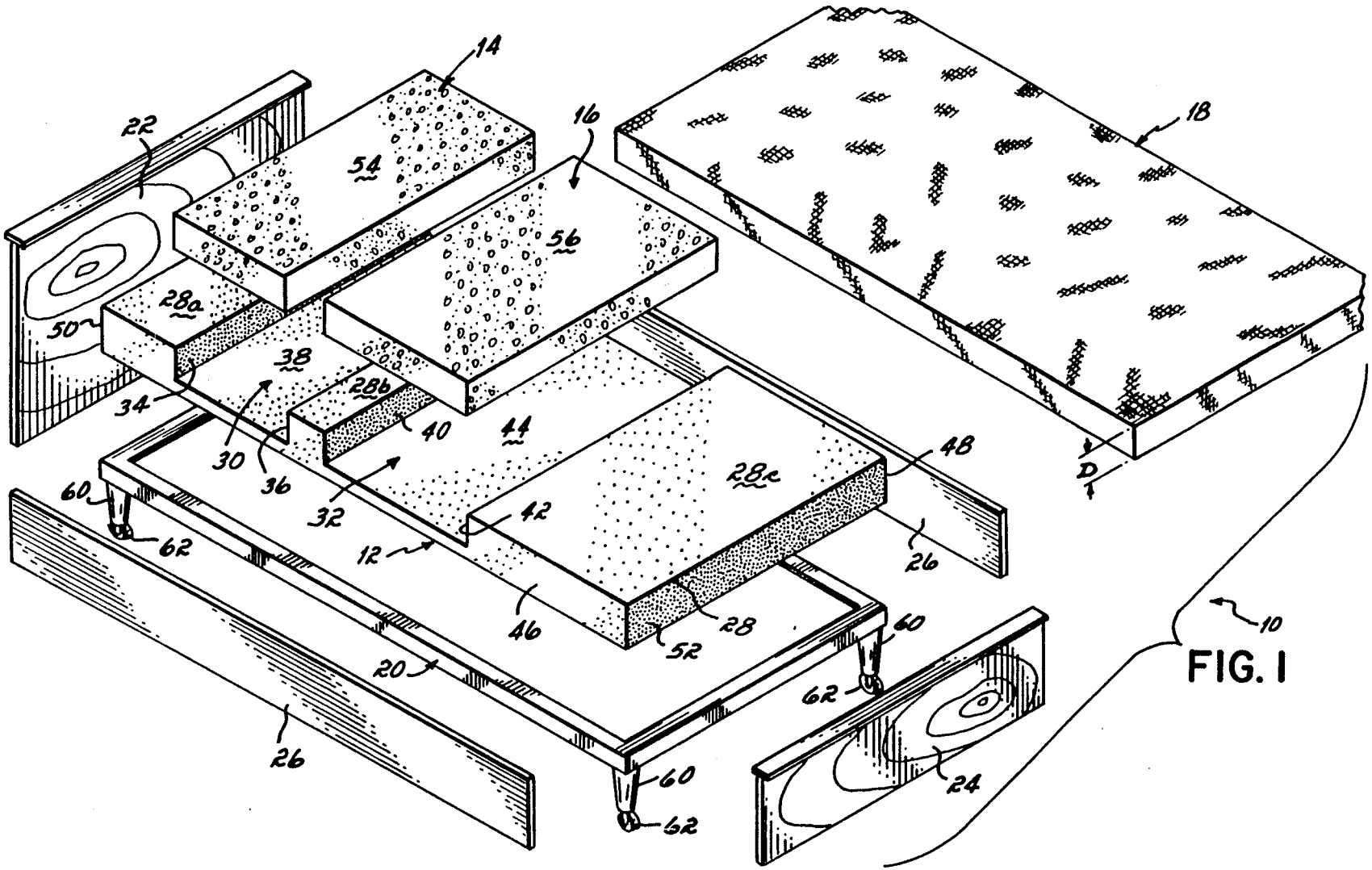
FIG. 1 is an exploded perspective view of a bedding system embodying the invention of this application.
Figure 2:
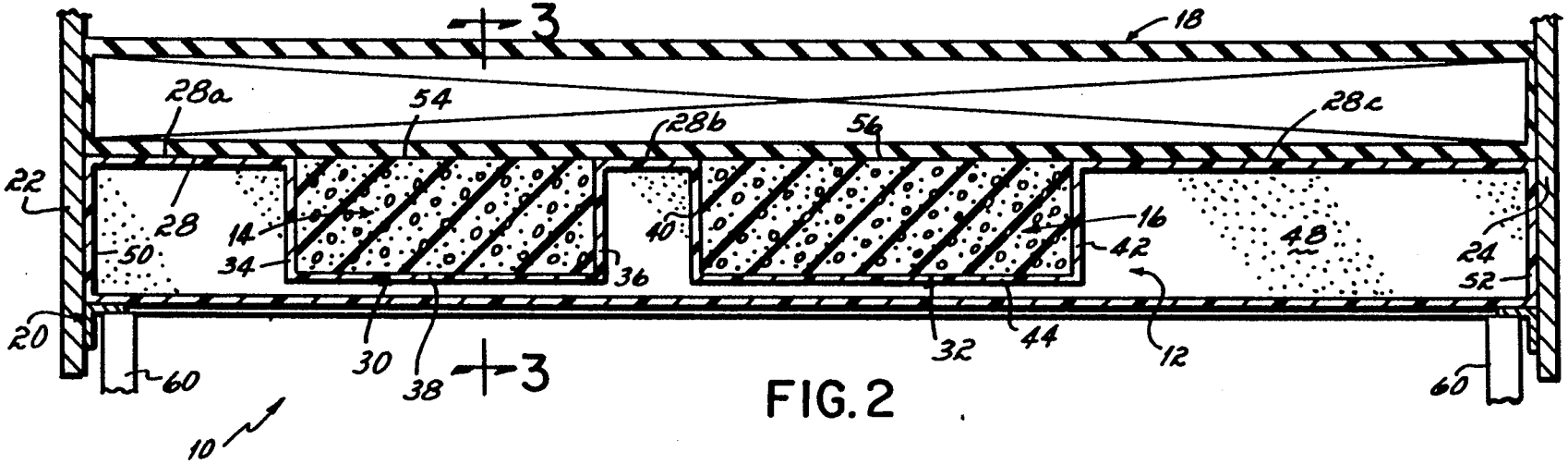
FIG. 2 is a cross-sectional view through the bed of FIG. 1, when the components of that bed are assembled.
Figure 3:
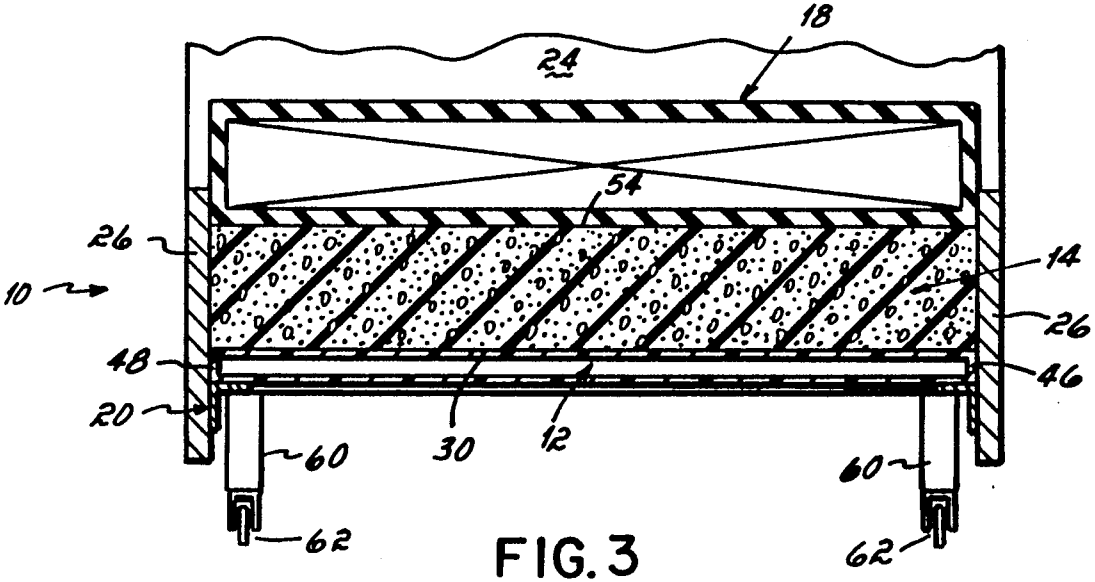
FIG. 3 is a cross-sectional view taken on line 3—3 of FIG. 2.

With reference first to FIG. 1, there is illustrated a bedding system 10 embodying the invention of this application. This bedding system comprises a rigid bed platform 12, a pair of resilient cushions 14, 16 and a mattress 18. In the illustrated embodiment, the system also includes a supporting frame 20, as well as a headboard 22, footboard 24 and a pair of sideboards 26.

The platform 12 is shaped as a rectangular parallelepiped or, as it is more commonly known, as a rectangular box. The top surface 28 of the platform is generally horizontal but has two longitudinally spaced depressions 30, 32 formed therein. Each of these depressions is also shaped as a rectangular parallelepiped. The depression 30 nearest the head end of the bed platform comprises a pair of vertical walls 34, 36 and a bottom wall 38, each of which extends for the full width of the bed platform 12. Similarly, the second depression 32 is shaped as a rectangular parallelepiped. It has vertical walls 40, 42 and a bottom wall 44 which extend for the full width of the bed. In practice, the depressions 30, 32 extend downwardly from the top horizontal surface 28 of the bed platform 12 to a depth of approximately four inches.

In addition to the horizontal top surface of the top wall 28, the bed platform 12 has a pair of sidewalls 46, 48 and a pair of end walls 50, 52. In practice, these walls may all be of minimal thickness if the bed platform is fabricated, or the platform may be solid between the sidewalls 46, 48 if the platform is made from a lightweight molded material. The bed platform 12 may be fabricated from sheet metal or pressed from sheet steel. Alternatively, it may be made of fiberboard or molded plastic. Irrespective of the material from which the platform 12 is manufactured, though, it is a rigid structure which is subject to minimal or no vertical deflection when a person or persons are reclining or sleeping atop the bedding system. The platform, though, is a substantially rigid structure having a top horizontal surface 28 divided into three longitudinally spaced sections: One section 28*a* at the head end of the platform, another section 28*c* at the foot end of the platform, and a middle section 28*b* intermediate the two end sections 28*a*, 28*c* of the top horizontal surface 28.

The resilient cushion 14 resides within the depression 30 of the bed platform 12, and the resilient cushion 16 resides within the depression 32. Each cushion is also shaped as a rectangular parallelepiped, and each cushion conforms to the shape of the depression within which it is located. In other words, each cushion is of the same width as the width of the bed platform 12 and is of approximately the same length as the depression within which it fits. Additionally, each cushion is of the same vertical height as the depression within which it fits so that when located within the depressions 30, 32, the top surfaces 54, 56 of the cushions 14 and 16 reside in the same horizontal plane as the top surface 44 of the bed platform 12.

In the preferred practice of this invention, the bed platform 12 is supported upon a supporting frame 20 which may be a conventional "Hollywood" style of bed frame made from right-angle channels and supported upon legs 60 having casters 62 at their lower end. The bedding system 10 is completed by the addition of a headboard 22, footboard 24 and sideboards 26 secured to the supporting frame 20.

The mattress 18 may preferably be a conventional mattress having springs or urethane foam or any other conventional resilient structure contained internally of the mattress to provide resiliency and support. Alternatively, the mattress 18 may be an air mattress of the type described in co-pending U.S. patent application Ser. No. 07/256,902 filed Oct. 12, 1988 and assigned to the assignee of this application, but modified to be of lesser vertical height. But, whether the resiliency of the mattress is provided by urethane foam or by springs or by pressurized air pockets, the mattress 18 is preferably a multiple-zone mattress of differing firmness over the surface area of the mattress. The multiple zones of the preferred mattress is divided into five longitudinal zones or sections 18*a*–18*e* by the mattress structure and by the cushions 14, 16 which underlie the mattress. These zones are a head section zone 18*a* located in one end of the mattress between that end of the mattress and the edge of the cushion 14, a shoulder section zone 18*b* overlying the cushion 14, a waist section zone 18 located between the cushions 14, 16, a hip section zone 18*d* overlying the cushion 16, and a foot section zone located between the cushion 16 and the end of the mattress. As explained more fully hereinafter, the purpose of these differing sections or zones is to enable a person to recline atop the mattress on either their side or back and have the mattress support the person in spinal alignment, i.e., in the position the spine would normally assume when the person is standing in a relaxed position and, preferably, with a minimum body supporting surface pressure. These differing sections 18*a*–18*e* conform in plan view and overlie the surfaces 28*a*, 30, 28*b*, 32 and 28*c*, respectively, of the bed platform. As illustrated in FIG. 5, the head section 18*a* of the mattress extends for approximately 2/15 of the length of the mattress, the shoulder section 18*b* of the mattress extends for approximately 3/15 of the length of the mattress, and the waist section 18*c* of the mattress extends for approximately 1/15 of the overall length. The hip section 18*d* of the mattress extends for approximately 4/15 of the length of the mattress, and the foot section extends for approximately 5/15 of the length of the mattress. Because of the differing resistance to vertical deflection imparted to the bedding system 10 by the resilient cushions underlying the mattress, the bedding system 10, when customized by specific firmness mattress and specific firmness cushions, ensures that a person reclining atop the mattress, as illustrated in FIG. 4, does so while maintaining spinal alignment from their head to their foot because of the differing depths which the different parts of their body sink into the mattress or, in the case of this bed, into the mattress 18 and cushions 14, 16, respectively.

Figure 4:
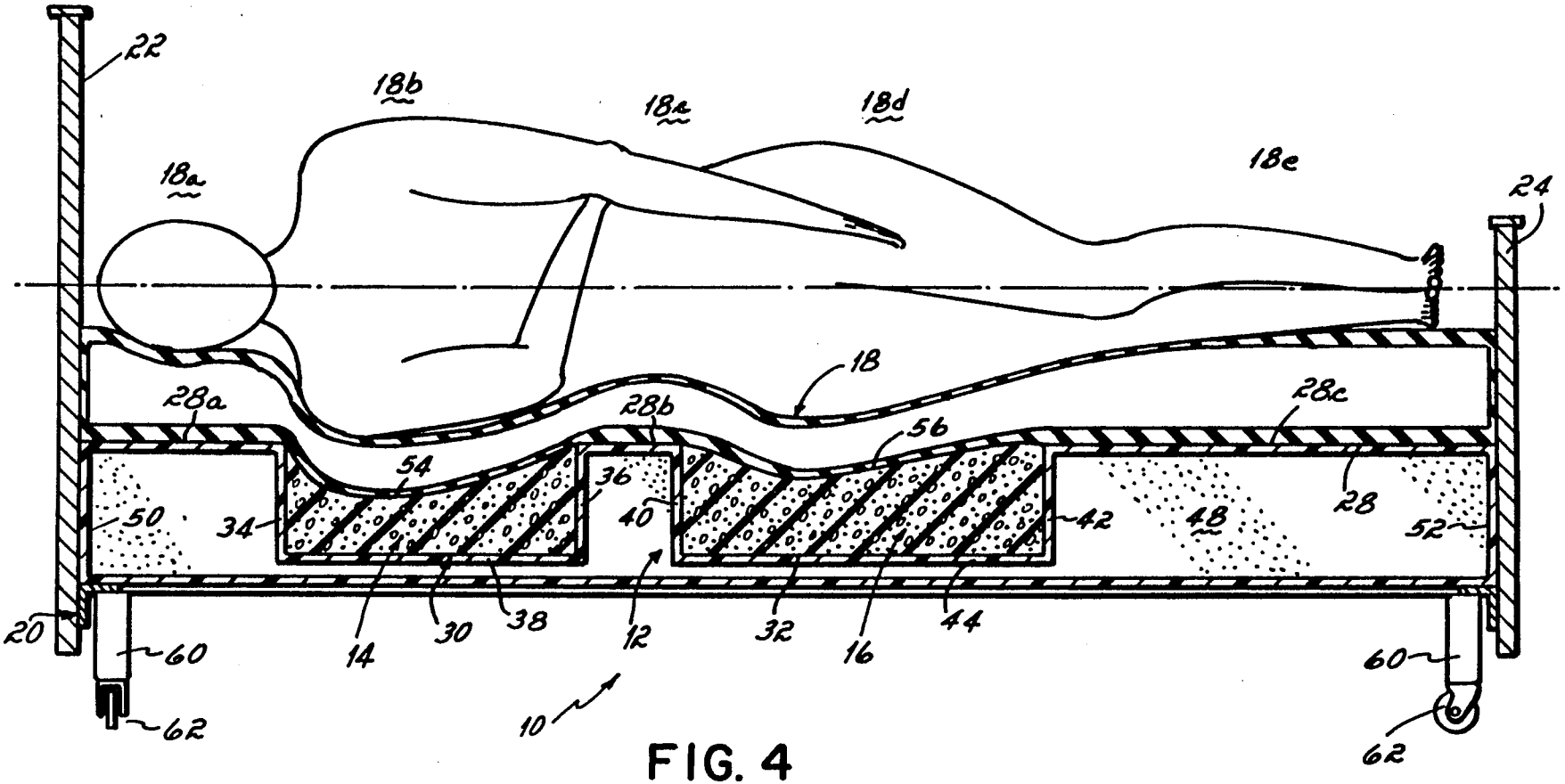
FIG. 4 is a cross-sectional view similar to FIG. 2, but illustrating the position assumed by the mattress and cushions when a person is resting on their side atop the mattress.
Figure 5:
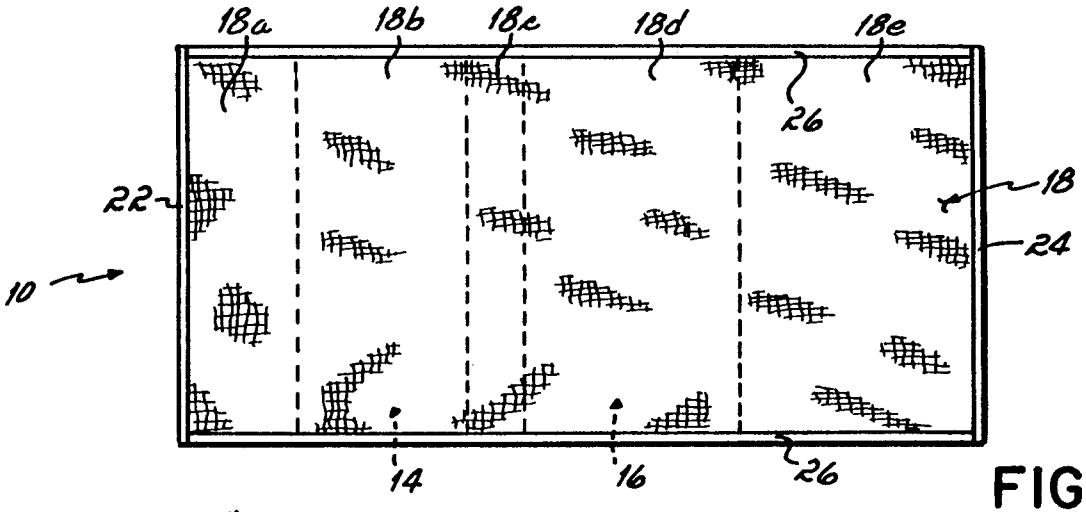
FIG. 5 is a top plan view of the zoned mattress of FIG. 1.

With reference now to FIG. 4, it will be seen that a person reclining atop the bedding system 10 of this invention sinks further into the mattress in the shoulder and hip zones of the mattress than in any other portion, even if those portions are of greater resistance to deflection than the head and leg support zones of the mattress. Obviously, persons of greater body density sink into the mattress and supporting cushions to a greater depth than lighter, lower-body density persons. Experimentation has established that a comfortable mattress which provides spinal alignment of a person reclining atop the mattress should be approximately eight inches in thickness in order to ensure that the heaviest body resting atop the mattress while reclining on their side does not bottom out on the mattress. That same overall deflection depth is available according to the practice of this invention, but the invention of this application enables a mattress to be made of much less thickness or depth D (FIG. 1). In the preferred practice of this invention, the mattress is only four inches in vertical depth, and the cushions 14 and 16 are similarly only four inches in depth. These dimensions could, of course, vary and could obviously be made greater than four inches, but four inches has been found to be particularly appropriate for the practice of one aspect of this invention.

The bedding system 10 of this invention lends itself to modularizing a customized bed. A customized bed, in accordance with the practice of this invention, is one in which the mattress 18 and cushions 14 and 16 are selected so as to match the weight and dimensions of a particular person and give that person a selection of firmness such that when that person is sleeping upon the customized bed, their body will be maintained in spinal alignment whether the person is sleeping on their side or back. In accordance with this aspect of this invention, a bedding system of this invention would be merchandized by a store which maintains an inventory of a plurality of mattresses of varying firmness and of varying lengths and widths, i.e., twin, regular, king and queen sizes. Whenever a person was to purchase a bedding system, that person would be weighed and measured and would choose a particular desired firmness feel for sleeping comfort, i.e., a mattress which was firm or soft or of medium firmness in feel. That customer's dimensions would then be utilized via a chart or a computer to select a mattress having that particular firmness feel, as well as a configuration which, when matched with selected cushions, would give rise to spinal alignment of that weight and dimension body when reclining atop the mattress. With the mattress and cushions selected and the bed platform being standard for any particular style of bed, i.e., twin, regular, queen or king, the person would then complete their bedding selection by choosing the bed surrounds to complete the bed, i.e., the footboard, headboard, sideboards and any other accessories associated with the bed.

It will now be appreciated that the invention of this application lends itself to modularized manufacture and sale of customized beds intended to provide for spinal alignment and reduce the costs of transport and assembly to each purchaser of a bed. Since comfort has been established to be in substantial part a function of the spinal alignment maintained while the person is sleeping in the bed, this modularized, customized bed will maximize the sleeping comfort of each bedding customer at a reduced cost.

As described hereinabove, the mattress 18 is either actually or effectively, as a result of the underlying surfaces, divided into five longitudinal zones 18*a*–18*e* (FIG. 5). These zones all differ in resistance to vertical deflection, either as a consequence of the internal structure of the mattress, or as a consequence of the resiliency or lack thereof, of the platform 12 and cushions 14 and 16.

With reference now to FIG. 7, there is illustrated in diagrammatic fashion a bedding system comprising a mattress 18 and cushions 14, 16 for obtaining spinal alignment of a person reclining atop the mattress, while simultaneously maintaining the lowest possible body supporting surface pressure on the surface of the person reclining on the mattress. This mattress is divided into three zones, A, B, and C, with the middle zone B being of differing firmness (i.e., resistance to vertical deflection) than the end zones A and C. The end zone A occupies the head zone 18*a* and shoulder zone 18*b* of the mattress, the middle zone B occupies the waist zone 18*c* of the mattress, and the end zone C occupies the hip zone 18*d* and foot zone 18*e* of the mattress. The cushion D underlies the shoulder zone of the mattress, and the cushion E underlies the hip zone of the mattress. In this example, it is envisioned that the mattress zone A, as well as the mattress zone C, would be of a common firmness, i.e., resistant to vertical deflection, while the mattress zone B would be of a differing and substantially greater firmness or resistance to vertical deflection. It is envisioned that in this example, this firmness or resistance to vertical deflection would be imparted to the mattress by springs contained internally of the mattress with the springs in the waist zone B being substantially more firm than the springs in the end zones A and C, respectively. In this example, it is also envisioned that the cushions 14 and 16 occupying the zones D and E beneath the shoulder and hip zones, respectively, of the mattress would also be resilient and have the resiliency imparted to the cushion by springs. In this example, it is envisioned that the cushion 14 occupying the zone D would be of the same firmness as the mattress in zones A and C and that the cushion 16 occupying the zone E would be of a greater firmness than the zones A and C of the mattress, but less than the firmness of the zone B of the mattress. A bedding system, such as that illustrated in FIG. 7, would then be characterized by a head zone 18*a* of a first firmness, a shoulder zone 18*b* of a second firmness or resistance to vertical deflection less than that of the head zone because of the underlying resiliency of the cushion 14, and a waist zone 18*c* of substantially greater resistance to vertical deflection than that of either the head zone 18*a* or shoulder zone 18*b*. Additionally, this bedding system would be characterized by a hip zone 18*d* of greater resistance to vertical deflection than that of either the head zone 18*a* or shoulder zone 18*b*, but less than that of the waist zone 18*c*. And, the foot zone 18*e* would be characterized by a firmness or resistance to vertical deflection equal to that of the head zone 18*a*.

A bedding system made in accordance with the differing resistances to vertical deflection described and illustrated in FIG. 7 would, in many instances, be capable of supporting a person reclining atop the bedding system on either their back or side in spinal alignment and with a minimal body supporting surface pressure because the person supported atop the mattress would sink into the mattress to a sufficient depth to maximize the area over which the body would be supported. Such a system would support many shapes and configurations of bodies in spinal alignment and with this minimum supporting body surface pressure. However, some bodies, because of their unusual height, weight and shape, might require a greater number, i.e., five, zones of differing firmness in the mattress even when the mattress is utilized in conjunction with cushions of differing firmness underlying the shoulder and hip zones of the mattress. Other persons, such as very light persons, might be capable of being supported on a mattress of two zones, or even a single zone, of firmness in the mattress with only differing zones of cushion firmness to obtain spinal alignment and lowest possible body surface pressure of the person supported atop the mattress. This last condition might be particularly applicable to very light, small bodies.

It is important to note that bedding systems employing the invention of this application take advantage of the principle that springs or resilient supports stacked one atop the other have differing rates of deflection (i.e., weight per linear unit of deflection) than the same springs when placed side by side. As a consequence of this characteristic of springs or resilient bodies, the bedding system of this invention can be made to support a person in spinal alignment atop the bedding system with minimal supporting body surface pressures imposed upon the body by the underlying bedding system and with a minimal height or thickness mattress, and particularly with a spring mattress which has heretofore not been capable of such support.

Figure 6:
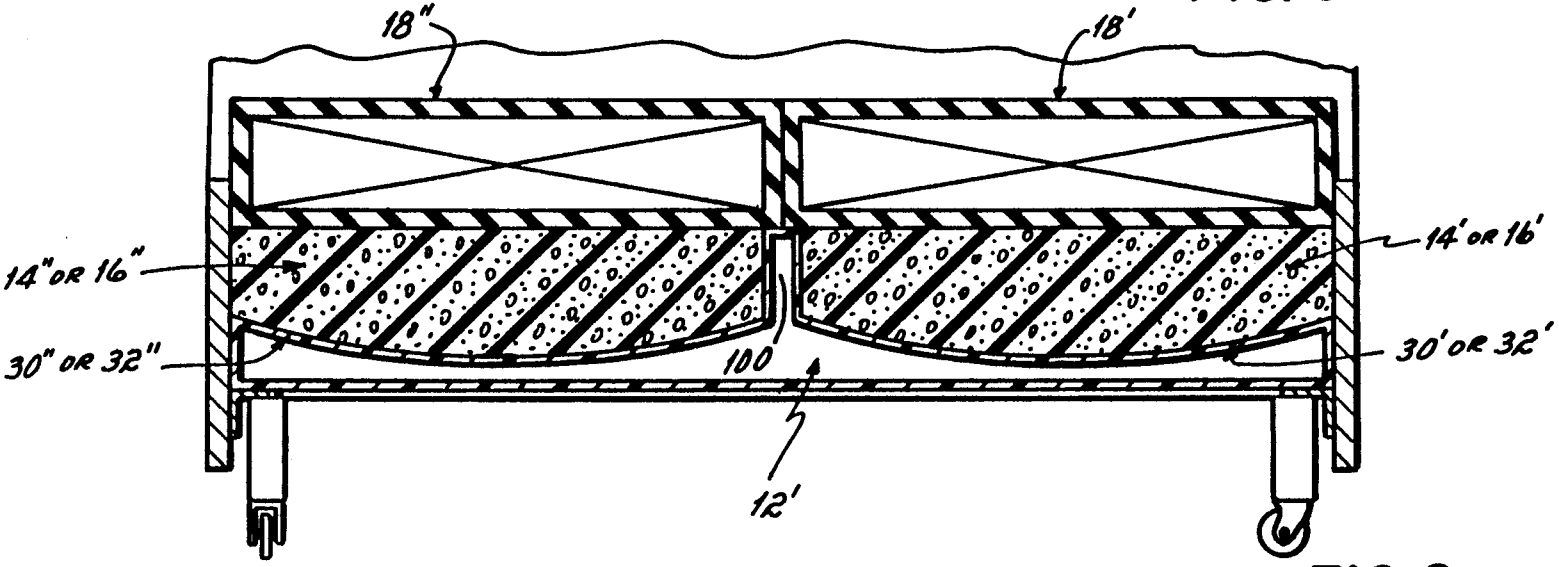
FIG. 6 is a cross-sectional view similar to FIG. 3, but of a double bed rather than a single bed.

With reference to FIG. 6, there is illustrated a second embodiment of the invention of this application. In this embodiment, the single bedding platform 12' supports two mattresses 18' and 18'' so as to make up a queen or king-sized bed. The bed platform 12' is divided longitudinally by a longitudinally extending vertical divider 100 which separates two transversely spaced cushions 14', 14'' or 16', 16'' in each of the depressions 30', 30'', or 32', 32'', respectively. In this bed, the bottom surface of the depressions 30', 30'' and 32', 32'' which receive each cushion is made concave, and the bottom surface of each cushion is convex from one side of the cushion to the center of the bed. This configuration of the bottom of the depressions and the bottom of the cushions facilitates a person sleeping or reclining atop the mattress being maintained more or less in the transverse center of their mattress.

In lieu of making the bed platform 12 in the shape of a rectangular parallelepiped with depressions formed therein, the bed platform 12 could as well be made from a flat sheet of material, such as a flat sheet of plywood, upon which there are placed blocks shaped as rectangular parallelepipeds. If the bed platform were made in this way, the head section of the bed platform might be in the form of a block of relatively rigid foam, and similarly, the raised foot section and waist section of the bed platform 12 could be made from relatively rigid foam. In this event, the top surfaces of the relatively rigid foam blocks making up the head, waist and foot sections of the bed platform would all have a flat horizontal top surface located in the same top surface as the top surface of the resilient cushions 14', 14'' and 16', 16'', respectively.

Figure 9:
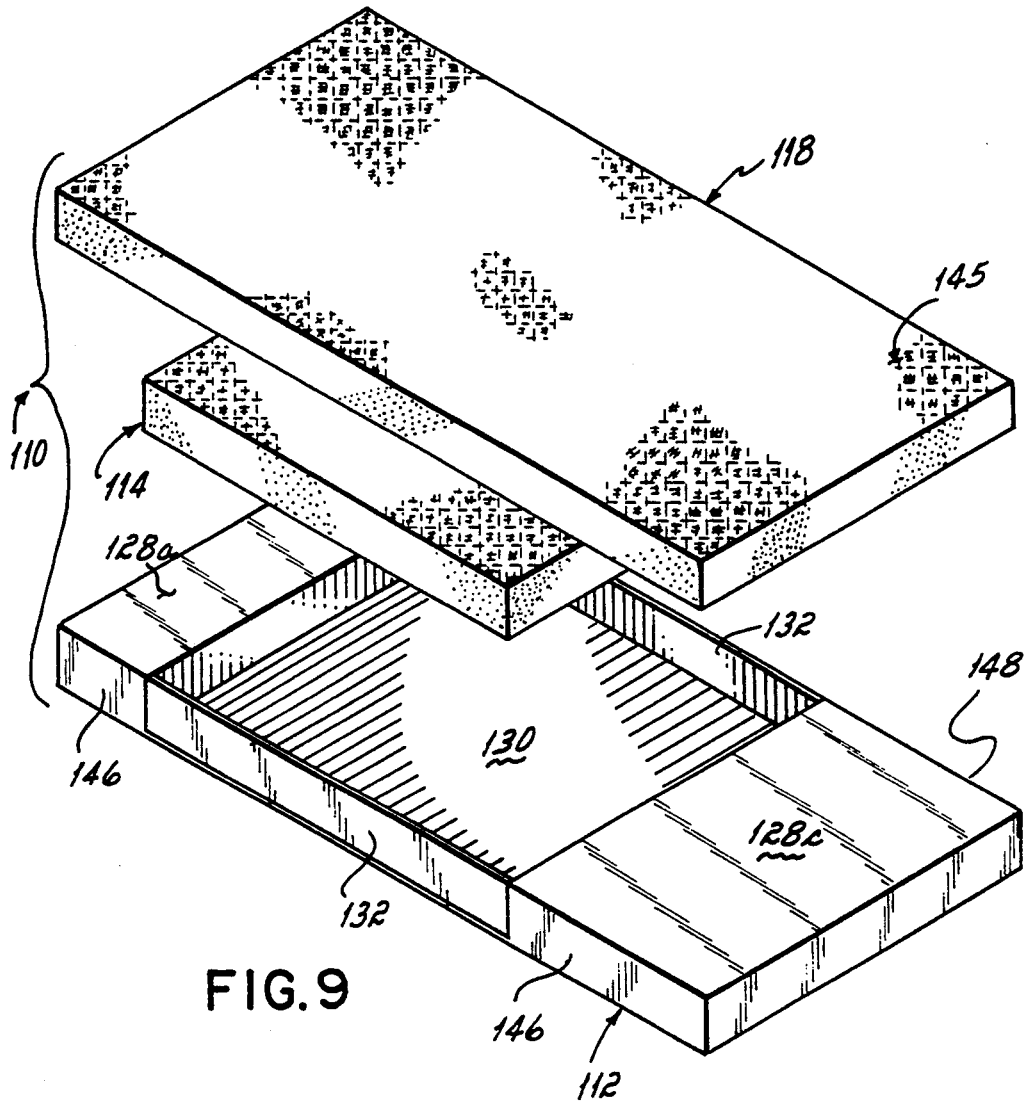
FIG. 9 is an exploded perspective view of the bedding system diagrammatically illustrated in FIG. 8.
Figure 10A:
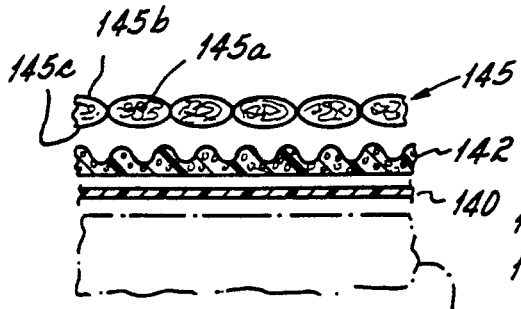
FIG. 10A is an enlarged view of the encircled area 10A of FIG. 10.
Figure 10B:
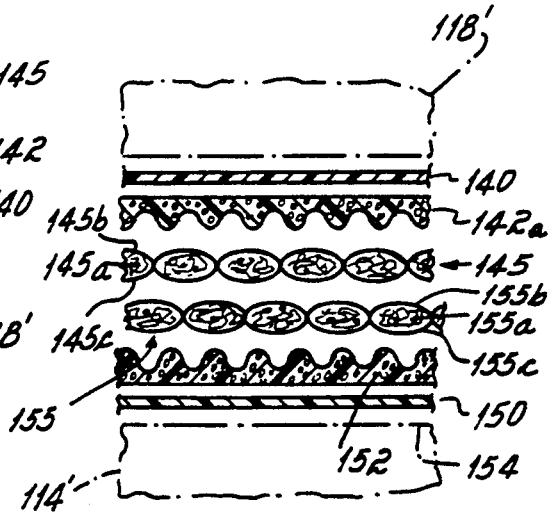
FIG. 10B is an enlarged view of the encircled area 10B of FIG. 10.
Figure 10:
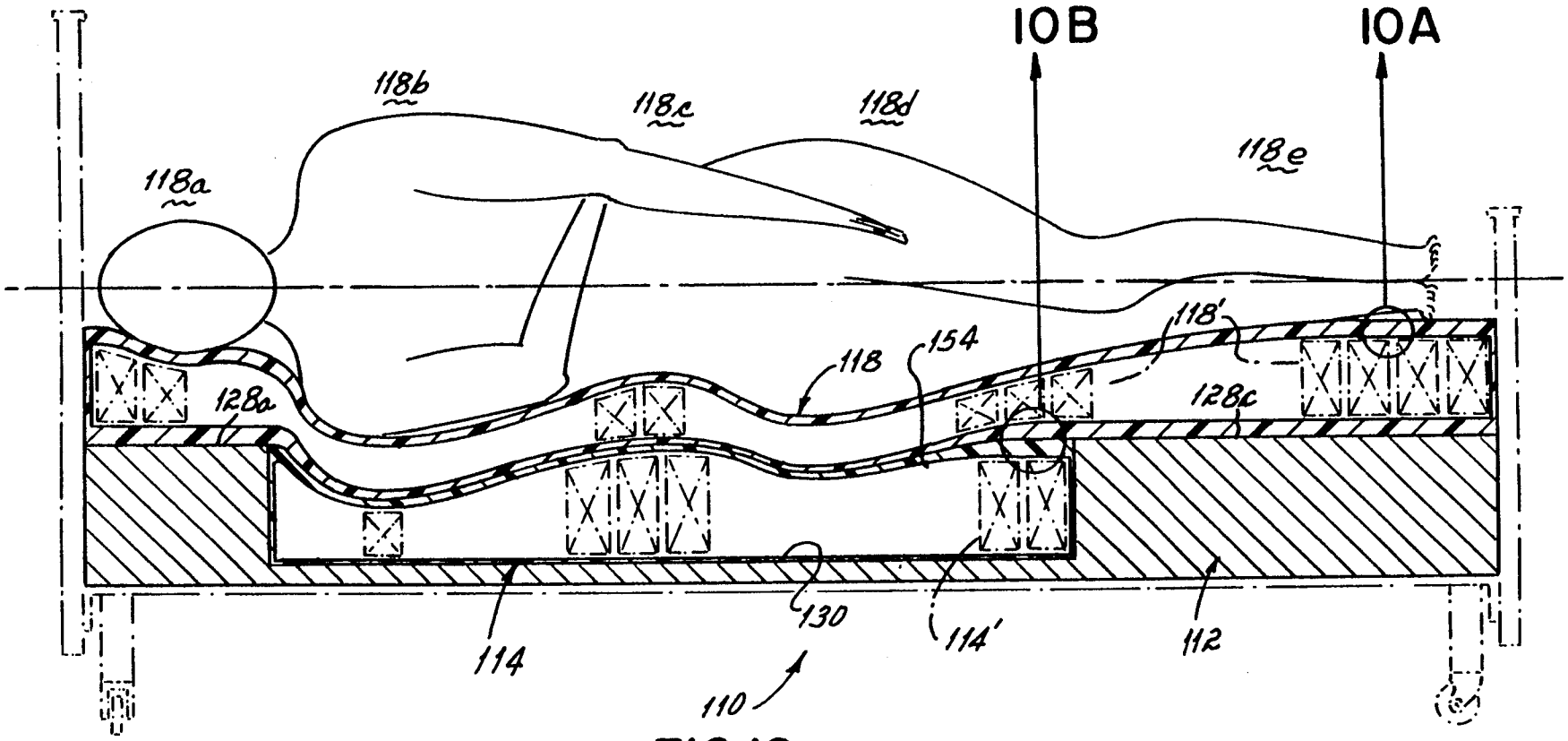
FIG. 10 is a cross-sectional view taken on line 10—10 of FIG. 9.

With reference now to FIGS. 8, 9 and 10, there is illustrated yet another embodiment of this invention. This embodiment differs from the embodiment illustrated in FIGS. 1 through 5, principally in that it utilizes a single cushion insert 114, and a single depression 130 of a rigid platform 112, rather than two cushions in two spaced depressions as of the rigid platform 12. This single cushion 114 extends from beneath the shoulder zone 118*b* of the mattress to beneath the hip zone 118*d*, and includes a center or waist zone section 118*c* of increased firmness relative to the remainder or shoulder and hip zone sections of that cushioned insert.

With reference now to FIG. 9, it will be seen that the bedding system 110 of this embodiment comprises a conventional "Hollywood" bed frame (not shown), atop which there rests the rigid platform 112. This platform is shaped as a rectangular parallelepiped which extends for the full length and width of the bed. It has the single depression 130 in the top surface thereof. This depression or recess is approximately the full width of the platform and extends over more than half the length of the platform. It is positioned beneath the shoulder, waist and hip zones of the mattress 118 which rests atop the platform.

The cushion insert 114 is also shaped generally as a rectangular parallelepiped. It is of the same depth and shape as the depression 130 in the rigid platform 112, so that it fills the depression and has its top surface 154 located coplanar with the top horizontal surfaces 28*a* and 28*c* of the rigid platform 112.

In the preferred embodiment, there are a pair of boards or slats 132 which fit against and are co-planar with the vertical side walls 146, 148 of the platform 112. These boards are of the same height as the platform 112 and have their upper edges coplanar with the top surfaces 128*a* and 128*c* of the platform. The length of these slats 132 is the same as the length of depression 130. As a consequence of the addition of these sideboards to the side wall of the platform, the depression 130 is enclosed on the sides with the result that the cushion 114 received within the depression cannot inadvertently slide sideways out of the depression.

The cushion 114 is divided lengthwise into three zones of differing firmness. The first of these zones, the zone 114*b* is a shoulder zone, which is positioned beneath the shoulder of a person reclining atop the bedding system 110. The center zone 114*c* is positioned beneath the waist of a person reclining atop the bedding system 110. The opposite end section 114*d* is positioned beneath the hips of a person reclining atop the bedding system 110. In terms of relative length, the shoulder zone 114*b* extends for approximately ⅜ths the length of the cushion, the waist zone 114*c* extends for approximately ⅜th the length of the cushion and the hip zone 114*d* extends for approximately ⅜ths the length of the cushion.

The cushion 114 is vertically resilient. In the preferred embodiment, the resiliency of the cushion is provided by conventional bedding springs contained internally of the cushion. These springs are arranged in transversely extending rows and may be in the form of conventional cylindrical springs, hour glass shaped springs, or even rows of springs formed from a continuous single strand of wire. Alternatively, and while the resiliency of the cushion is preferably derived from metal springs, the cushion may have its resiliency imparted by an elastomeric material as for example, foam urethane of the type conventionally utilized in mattresses. But irrespective of the source of the resiliency of the cushion, it is important that the center waist section 114*c* of the cushion be substantially more firm than the endmost shoulder and hip zones 114*b* and 114*d*, respectively.

The mattress 118 is divided into five longitudinal zones, 118*a* through 118*e*. These zones are of four different firmnesses (i.e. resistance to vertical deflection). These zones comprise a head zone 118*a* which extends for approximately 2/15ths the overall length of the mattress, a shoulder zone 118*b* which is approximately 3/15ths the overall length of approximately 1/15th the length of the mattress, a hip zone 118*d* which is approximately 4/15ths the length of the mattress, and a leg or foot zone 118*e* which is approximately 5/15ths the overall length of the mattress. Preferably, the shoulder zone 118*b* is divided into two lengthwise sections, the upper or head end of which represents 2/15ths the overall length of the shoulder zone and the lower end of which is approximately 1/15th the overall length of the mattress. As illustrated in FIG. 8, the zones of the mattress are of differing firmnesses. The waist zone 118*c* is substantially more firm (firmness A) than the other zones. The head zone 118*a* and the lower end of the shoulder zone 118*b* are the next most firm (firmness B). The hip and leg zones 118*d* and 118*e* are the least firm (firmness D). And the upper end of the shoulder zone 118*b* is more firm (firmness C) than the hip and foot zones 118*d* and 118*e* (firmness D) but less firm than the head and lower end of the shoulder zone (firmness B). Preferably, these differing firmnesses of the differing zones of the mattress result from springs of differing characteristics within each of the zones. These differing firmnesses may be the result of differing gauge wire utilized to manufacture the springs in each zone or of differing heat treatment to otherwise identical springs. Alternatively, the springs of the insert 114 may be made of differing composition wire. Preferably, though, the springs of the shoulder zone 114*b* and hip zone 114*d* of the cushion insert 114 are of the same firmness (firmness C) as the springs of the upper end of the shoulder zone 118*b* of the mattress and the springs of the center most section of the 114*c* of the cushion insert are of the same firmness (firmness A) as the waist zone 118*c* springs of the mattress. Alternatively, if the resiliency of the mattress is imparted by resilient foam material, then the same firmness foam material is utilized in the end most zones 114*b* and 114*d* of the cushion insert 114 as is utilized in the upper end of the shoulder zone 118*b* of the mattress and similarly, the same firmness foam resilient material is utilized in the center most section 114*c* of the cushicn insert 114 as is used in the waist zone 118*c* of the mattress.

In the example illustrated in FIGS. 8 through 10, the shoulder zone of the mattress incorporates springs of differing firmness (firmness B and firmness C) in order to provide a smoother transition of firmnesses between the shoulder zone and the waist zone of the bedding system. By utilizing springs of intermediate firmness B between the shoulder zone and the waist zone, a person reclining atop the mattress is less likely to feel a substantial difference between the two zones when reclining atop the mattress.

There are several advantages to the bedding system illustrated in FIGS. 8 through 10 over that illustrated in FIGS. 1 through 5. One of the advantages is that there is a smoother transition in firmness of support between the shoulder zone and the waist zone of the bedding system, with the result that the bedding system may have a better feel to a person reclining atop the mattress with their waist located over the waist zone of the mattress. Additionally, because this latter system utilizes only a single cushion rather than a pair of cushions, it is less expensive to manufacture and upholster than the two cushions of the embodiment of FIG. 1 through 5. Furthermore, a rigid platform with a single depression is generally less expensive to manufacture than a pair of spaced depressions. Furthermore, the system illustrated in FIGS. 8 through 10 has the advantage of conforming more easily to the body shape of a person reclining atop the mattress than does the bedding system of FIGS. 1 through 5. But both systems have the capability of supporting a person reclining atop the mattress in spinal alignment and with a minimal body supporting surface pressure because the person supported atop the mattress sinks into the mattress to a sufficient depth to maximize the area over which the body is supported.

In order to better take advantage of the principal that multiple springs or multiple resilient supports stacked one atop the other have differing rates of deflection, (i.e. weight per linear unit of deflection) than the same springs when placed side by side, the invention of this application utilizes unique facing materials on the top and bottom surfaces of the mattress 118 and on the top surface of the cushion insert 114. These facing materials are intended to permit the transfer of forces from the top of the mattress through the mattress and into the cushion insert 114 with a minimum of interference by the covering materials on the mattress and on the cushion insert.

With reference to FIG. 10, it will be seen that the top of spring assembly 118' of the mattress 118 is covered by a conventional plastic insulator which rests atop the springs. That insulator 140, is in turn covered by a one and one-quarter (1¼") inch layer of convoluted foam 142 which is generally a layer of polyurethane foam which has been convoluted by a conventional process wherein a regular pattern of protrusions and depressions appear in the surface of the foam. This convoluting of the surface of the foam imparts a softer "feel" to the foam than is imparted if the layer of foam has a flat surface.

The layer of resilient foam 142 is, according to the practice of this invention, covered by a quilted covering material 145 in the form of a layer 145*a* of one-half ounce polyester fiber sandwiched between two-plies 145*b*, 145*c* of elasticated ticking material. The two-plies 145*b*, 145*c* of elasticated ticking material each comprise a layer of four-way stretch fabric. By utilizing four-way stretch ticking material to encase the center-ply 145*a* of polyester fiber, a very soft feel is imparted to the top of the mattress but additionally, a covering material is provided on the top of the mattress which enables pressure to be evenly imparted through the covering of the top of the mattress into the springs of the spring assembly 118'.

The bottom of the mattress is covered very similarly to the top of the mattress, except that instead of a convoluted foam ply 142 located between the plastic insulator 140 and the quilted covering 145, there is a flat ply of ⅜th inch thick poly-foam 142*a*. The plastic insulator 140 and the quilted surface layer 145 on the bottom of the mattress are identical to the plastic insulator 140 and the quilted surface layer 145 on the top of the mattress, therefore, they have been given the same reference numerals.

The upper surface 154 of spring assembly 114' of the cushioned insert 114 is covered with exactly the same combination of materials as is the bottom of the mattress. That is, there is an all plastic insulator pad 150 covering the top surface of the spring assembly 114'. This insulator pad 150 is in turn covered by a layer of ⅜ inch poly-foam and the poly-foam layer 152 is in turn covered by a quilted surface layer 155. That quilted surface layer comprises a ply of one-half ounce per square foot polyester fiber 155*a* sandwiched between two-plies of elasticated ticking 155*b*, 155*c*. The three-plies, 155*a*, *b* and *c* of the quilted surface layer 155, are sewn with a quilted pattern, so as to impart a pleasing appearance to the covering material. Additionally, the elasticated ticking material, with its four-way stretch characteristic, enables the pressure applied to the top of the mattress to be transferred through the mattress and through the covering materials on the cushion assembly into the springs of the cushion spring assembly 114'.

The bottom of the cushion insert 114 is covered with any conventional covering material. To that end, a conventional covering material such as a sheet of non-woven plastic, or even a sheet of woven fabric may be placed over the bottom of the spring unit, either with or without the presence of an insulator pad.

While I have described only a relatively few embodiments of my invention, persons skilled in this art will appreciate changes and modifications which may be made without departing from the spirit of my invention. Therefore, I do not intend to be limited except by the scope of the following claims.

I claim:

1. A bedding system comprising

A rigid non-resilient support platform, said platform having a planar top surface within which there are two longitudinally spaced depressions, a single rigid protrusion between said depressions, said depressions defining a shoulder and a hip zone and the rigid protrusion between said depressions defining a waist zone, a resilient cushion received within each of said two depressions, said cushions each having a planar top surface, said top surfaces of said cushions and said top surface of said platform all being coplanar, and a mattress having a flat planar top surface and a flat planar bottom surface, said flat planar bottom surface of said mattress being received atop and supported from said coplanar top surfaces of said cushion and said platform such that a person reclining atop said mattress will have the shoulders and hips positioned over the shoulder and hip zones of said platform and over the cushions received within the depressions of the platform located in said zones and will have the waist located over the space between said depressions of said platform.

2. The bedding system of claim 1 wherein said mattress comprises a plurality of longitudinally spaced sections, said sections being of differing resistance to vertical deflection over the length of said mattress.

3. A bedding system for achieving spinal alignment of a person reclining atop said system, said system comprising a rigid non-resilient platform, said platform having a horizontal planar top surface, a pair of depression means in said horizontal top surface, said depression means being separated by a single rigid protrusion, said depression means having a bottom wall and longitudinally spaced, substantially vertical walls, at least two resilient cushions received in said depression means, said cushions being received in a shoulder zone and a hip zone of said platform, said cushions having a bottom surface and longitudinally spaced end walls, said bottom surface of said cushions being of the same contour as the bottom wall of said depression, said cushions having a top surface which is coplanar with said top surface of said platform, and a mattress having a flat planar top surface and a flat planar bottom surface, said flat planar bottom surface of said mattress being received atop and supported from said coplanar top surfaces of said cushions and said platform such that a person reclining atop said mattress will have the shoulders and hips located over the shoulder and hip zones of said platform and over the cushions received in the depression means of said platform.

4. The bedding system of claim 3 wherein said mattress comprises a plurality of longitudinally spaced sections, said sections being of differing resistance to vertical deflection over the length of said mattress.

5. A bedding system for achieving spinal alignment of a person reclining atop said system, said system comprising a rigid non-resilient platform, said platform having a horizontal planar top surface, two longitudinally spaced depressions separated by a single protrusion, said depressions each having a bottom wall and a pair of longitudinally spaced, substantially vertical walls, said depressions defining a shoulder zone and a hip zone of said platform, said platform having a waist zone located over the single protrusion and between said shoulder and hip zones, a resilient cushion received in each of said depressions, each said cushion having a bottom surface and longitudinally spaced end walls, said bottom surface of each said cushion being of the same contour as the bottom wall of the depression within which the cushion is received, and said longitudinally spaced, substantially vertical end walls of each cushion residing in juxtaposition to the end walls of the depression within which the cushion is received, said cushions each having a top surface which is coplanar with said top surface of said platform, and a mattress having a flat planar top surface and a flat planar bottom surface, said flat planar bottom surface of said mattress being received atop and supported from said coplanar top surfaces of said cushions and said platform such that a person reclining atop said mattress will have the shoulders and hips positioned over the shoulder and hip zones of said platform and over the cushions received within the depressions of the platform located in said zones and will have the waist located over the space between said depressions of said platform.

6. A bedding system for achieving a spinal alignment of a person reclining atop said system, said system comprising a rigid platform, said platform having a horizontal planar top surface, two longitudinally spaced depressions separated by a single protrusion, said depressions each having a bottom wall and a pair of longitudinally spaced, substantially vertical walls, said depressions defining a shoulder zone and a hip zone of said platform, said platform having a waist zone located over the single protrusion and between said shoulder and hip zones, a resilient cushion received in each of said depressions, each said cushion having a bottom surface and longitudinally spaced end walls, said bottom surface of each said cushion being of the same contour as the bottom wall of the depression within which the cushion is received, and said longitudinally spaced, substantially vertical end walls of each cushion residing in juxtaposition to the end walls of the depression within which the cushion is received, said cushions each having a top surface which is coplanar with said top surface of said platform, a mattress having a flat planar top surface and a flat planar bottom surface, said flat planar bottom surface of said mattress being received atop and supported from said coplanar top surfaces of said cushions and said platform such that a person reclining atop said mattress will have the shoulders and hips positioned over the shoulder and hip zones of said platform and over the cushions received within the depressions of the platform located in said zones and will have the waist located over the space between said depressions of said platform and comprising a plurality of longitudinally spaced sections, said sections being of differing resistance to vertical deflection over the length of said mattress.

7. A method of achieving spinal alignment of a person reclining atop a customized modular bedding system, which system comprises a bed rigid non-resilient support platform having a top surface located in a horizontal plane and two depressions separated by a single raised protrusion, a resilient cushion received within each depression, each cushion having a top surface which is coplanar with the top surface of the bed support platform, a mattress overlying and supported atop the coplanar top surfaces of said bed platform and said cushions, which method comprises weighing and measuring the dimensions of a person who is to sleep atop the bedding system, selecting a mattress from a plurality of mattresses having differing characteristics for achieving spinal alignment of persons of differing weight and dimensions when those persons are reclining atop the mattresses, which selected mattress has the cushion characteristic desired by the measured person, and selecting a pair of cushions from a plurality of cushions, which selected cushions are matched to the selected mattress for firmness and for achieving spinal alignment of the measured person when reclining atop the bedding system, and assembling the platform, cushions and mattress into a bedding system for supporting the measured person in a position of spinal alignment when that person reclines atop the assembled system.

8. A method of achieving spinal alignment of a person reclining atop a customized modular bedding system, which system comprises a bed rigid non-resilient support platform having a top surface located in a horizontal plane and two depression means in said top surface separated by a single protrusion, a pair of resilient cushions received within the depression means, the cushions having a top surface which is coplanar with the top surface of the bed support platform, a mattress having a planar bottom surface overlying and supported atop the coplanar top surfaces of said bed platform and said cushions, which method comprises weighing and measuring the dimensions of a person who is to sleep atop the bedding system, selecting a mattress from a plurality of mattresses having differing characteristics for achieving spinal alignment of persons of differing weight and dimensions when those persons are reclining atop the mattresses, which selected mattress has the cushions characteristic desired by the measured person, selecting cushions from a plurality of cushions for use in such system, which cushions are of differing resistance to vertical deflection and which selected cushions are matched to the selected mattress for firmness and for achieving spinal alignment of the measured person when recling atop the bedding system, and assembling the platform, cushions and mattress into a bedding system for supporting the measured person in a position of spinal alignment when that person is reclining atop the assembled bedding system.

9. A bedding system comprising

A rigid support platform, said platform having a planar top surface within which there is at least one depression, said depression defining shoulder, waist and hip supporting zones of a person reclining atop said bedding system, said planar top surface of said platform defining head and leg supporting zones of a person reclining atop said bedding system, a resilient cushion received within said depression, said cushion having a planar top surface, said top surface of said cushion and said top surface of said platform being coplanar, and said cushion being divided into shoulder, waist and hip supporting sections, said sections being adapted to support the shoulder, waist and hips of a person reclining atop said bedding system, and said waist section of said cushion being of greater firmness than the shoulder and hip sections, and a mattress having a flat planar top surface and a flat planar bottom surface, said flat planar bottom surface of said mattress being received atop and supported from said coplanar top surfaces of said cushion and said platform such that a person reclining atop said mattress will have the shoulders, waist and hips positioned over the shoulder, waist and hip support zones of said platform and over the cushion received within the depression of the platform located in said zones.

10. The bedding system of claim 9 wherein said mattress comprises a plurality of longitudinal sections, said sections being of differing resistance to vertical deflection over the length of said mattress.

11. A bedding system comprising a substantially rigid non-resilient support platform, said platform having a planar top surface defining head and leg supporting zones of a person reclining atop the bedding system, at least one depression in the planar top surface of said platform, said depression defining shoulder, waist, and hip supporting zones of a person reclining atop said bedding system, said zones extending lengthwise of said platform, resilient cushion means of substantially less firmness than said substantially rigid support platform, said cushion means being received within said depression of said platform, said cushion means having a planar top surface, said top surface of said cushion means and said top surface of said platform being coplanar, a mattress having a flat planar top surface and a flat planar bottom surface, said mattress being of substantially less firmness than said substantially rigid support platform, said flat planar bottom surface of said mattress being received atop and supported from said coplanar top surfaces of said cushion means and said platform such that a person reclining atop said mattress will have the shoulders, waist, and hips positioned over the shoulder, waist, and hip support zones of said platform and over the cushion means received within the depression of the platform located in said zones and will have the head and legs supported independently of the cushion means over the planar top surface of the platform and mattress of the bedding system, said cushion means being separate from said mattress and said cushion means and said mattress being separately removable from said support platform, and said cushion means and said depression of said platform extending over more than one half of the total length of said platform.

12. A bedding system comprising a substantially rigid support platform, said platform having a planar top surface defining head and leg supporting zones of a person reclining atop the bedding system, at least one depression in the planar top surface of said platform, said depression defining shoulder, waist, and hip supporting zones of a person reclining atop said bedding system, a resilient cushion of substantially less firmness than said platform received within said depression of said platform, said cushion having a planar top surface, said top surface of said cushion and said top surface of said platform being coplanar, a mattress having a flat planar top surface and a flat planar bottom surface, said flat planar bottom surface of said mattress being received atop and supported from said coplanar top surfaces of said cushion and said platform such that a person reclining atop said mattress will have the shoulders, waist, and hips positioned over the shoulder, waist, and hip support zones of said platform and over the cushion received within the depression of the platform located in said zones and will have the head and legs supported independently of the cushion over the planar top surface of the platform and mattress of the bedding system, and said mattress comprising a plurality of longitudinal sections, said sections being of differing resistance to vertical deflection over the length of said mattress.

13. A bedding system comprising a substantially rigid support platform, said platform having a planar top surface defining head and leg supporting zones of a person reclining atop the bedding system, at least one depression in the planar top surface of said platform, said depression defining shoulder, waist, and hip supporting zones of a person reclining atop said bedding system, a resilient cushion of substantially less firmness than said platform received within said depression of said platform, said cushion having a planar top surface, said top surface of said cushion and said top surface of said platform being coplanar, a mattress having a flat planar top surface and a flat planar bottom surface, said flat planar bottom surface of said mattress being received atop and supported from said coplanar top surfaces of said cushion and said platform such that a person reclining atop said mattress will have the shoulders, waist, and hips positioned over the shoulder, waist, and hip support zones of said platform and over the cushion received within the depression of the platform located in said zones and will have the head and legs supported independently of the cushion over the planar top surface of the platform and mattress of the bedding system, and said cushion comprising a plurality of longitudinal zones, at least one of said zones of said cushion being of differing firmness from the other zones of said cushion.

14. A bedding system comprising

A rigid support platform, said platform having a planar top surface defining head and leg supporting zones of a person reclining atop said bedding system, said planar top surface having at least one depression, said depression defining shoulder, waist, and hip supporting zones of a person reclining atop said bedding system, a metal spring containing resilient cushion received within said depression, said cushion having a planar top surface, said top surface of said cushion and said top surface of said platform being coplanar, a metal spring containing mattress having a flat planar top surface and a flat planar bottom surface, said flat planar bottom surface of said mattress being received atop and supported from said coplanar top surfaces of said cushion and said platform such that a person reclining atop said mattress will have the shoulders, waist, and hips positioned over the shoulder, waist, and hip support zones of said platform and over the cushion received within the depression of the platform located in said zones, and, said mattress having a bottom surface which comprises an elastic covering material and said cushion having a top surface which comprises an elastic covering material such that deflection of the springs of said mattress may be transferred from said mattress into the springs of said cushion with a minimum of resistance by the covering material on the bottom of said mattress and top of said cushion.

15. The bedding system of claim 14 wherein said mattress comprises a plurality of longitudinal sections, said sections being of differing resistance to vertical deflection over the length of said mattress.

16. The bedding system of claim 15 wherein said cushion comprises a plurality of longitudinal zones, at least one of said zones of said cushion being of differing firmness from the other zones of said cushion.

17. A method of achieving spinal alignment of a person reclining atop a customized modular bedding system, which system comprises a bed support platform having a length dimension and having a top surface located in a horizontal plane and at least one depression in said top surface, said depression having a length dimension which is substantially less than the length dimension of the platform, a resilient cushion of varying firmness throughout its length received within said depression, said cushion having a top surface which is coplanar with the top surface of the bed support platform, a mattress of varying firmness throughout its length overlying and supported atop the coplanar top surfaces of said bed platform and said cushions, which mattress has a length dimension substantially equal to the length dimension of said platform, which method comprises weighing and measuring the dimensions of a person who is to sleep atop the bedding system, selecting a mattress from a plurality of mattresses having differing characteristics for achieving spinal alignment of persons of differing weight and dimensions when those persons are reclining atop the mattresses, which selected mattress has the firmness characteristic desired by the measured person, and selecting a cushion from a plurality of cushions, which selected cushions is matched to the selected mattress for firmness and for achieving spinal alignment of the measured person when reclining atop the bedding system, and assembling the platform, cushions and mattress into a bedding system for supporting the measured person in a position of spinal alignment when that person reclines atop the assembled system.

18. A method of achieving spinal alignment of a person reclining atop a customized modular bedding system, which system comprises a bed support platform having a top surface located in a horizontal plane and at least one depression in said top surface, a resilient cushion of varying firmness throughout its length received within said depression, said cushion having a top surface which is coplanar with the top surface of the bed support platform, a mattress of varying firmness throughout its length overlying and supported atop the coplanar top surfaces of said bed platform and said cushions, which method comprises weighing and measuring the dimensions of a person who is to sleep atop the bedding system, selecting a mattress from a plurality of mattresses having differing characteristics for achieving spinal alignment of persons of differing weight and dimensions when those persons are reclining atop the mattresses, which selected mattress has the cushion characteristic desired by the measured person, and selecting a cushion from a plurality of cushions, each cushion of which comprises a plurality of longitudinal zones at least one of which is more firm than the other zones, which selected cushions is matched to the selected mattress for firmness and for achieving spinal alignment of the measured person when reclining atop the bedding system, and assembling the platform, cushions and mattress into a bedding system for supporting the measured person in a position of spinal alignment when that person reclines atop the assembled system.

19. A method of achieving spinal alignment of a person reclining atop a customized modular bedding system, which system comprises a bed support platform having a top surface located in a horizontal plane and at least one depression in said top surface, a resilient cushion of varying firmness throughout its length received within said depression, said cushion having a top surface which is coplanar with the top surface of the bed support platform, a mattress overlying and supported atop the coplanar top surfaces of said bed platform and said cushions, which method comprises weighing and measuring the dimensions of a person who is to sleep atop the bedding system, selecting a mattress from a plurality of mattresses having differing firmness characteristics, which selected mattress has the firmness characteristic desired by the measured person, and selecting a cushion from a plurality of cushions, each cushion of which comprises a plurality of longitudinal zones at least one of which is more firm than the other zones, which selected cushions is matched to the selected mattress for firmness and for achieving spinal alignment of the measured person when reclining atop the bedding system, and assembling the platform, cushions and mattress into a bedding system for supporting the measured person in a position of spinal alignment when that person reclines atop the assembled system.

* * * * *